US005377862A

United States Patent [19]

Oakes et al.

[11] Patent Number: 5,377,862

[45] Date of Patent: Jan. 3, 1995

[54] BOTTLE HOLDER AND BOTTLE HOLDING SYSTEM

[76] Inventors: Shawn A. Oakes, 315 Hamburg St., Ripon, Wis. 54971; Richard T. Steichen, 4545 W. Fisk Ave., Oshkosh, Wis. 54904; Michael S. Freitas, 1004 Santa Ana St., Laguna Beach, Calif. 92651; Joseph G. Toma, Jr., 198 Stonecliffe Aisle, Irvine, Calif. 92715; Daryl J. Gray, 27818 N. Crookshank Dr., Saugus, Calif. 91350

[21] Appl. No.: 123,150

[22] Filed: Sep. 20, 1993

[51] Int. Cl.[6] ..... B65D 21/00; B65D 81/16

[52] U.S. Cl. ..... 220/513; 206/433; 220/519

[58] Field of Search ..... 206/151, 158, 201, 203, 206/427, 433, 443, 446; 220/513, 515, 518, 519

[56] References Cited

U.S. PATENT DOCUMENTS

| | | | |
|---|---|---|---|
| 1,982,785 | 12/1934 | Buhrmmaster . | |
| 3,294,270 | 12/1966 | Geisler . | |
| 4,093,068 | 6/1978 | Smrt . | |
| 4,344,530 | 8/1982 | deLarosiere | 206/203 |
| 4,700,837 | 10/1987 | Hammett | 220/519 |
| 4,911,300 | 3/1990 | Colonna . | |
| 5,038,961 | 8/1991 | Watanabe et al. | 220/519 |

FOREIGN PATENT DOCUMENTS

| | | | |
|---|---|---|---|
| 0362091 | 4/1990 | European Pat. Off. | 206/427 |
| 2220196 | 1/1990 | United Kingdom | 206/821 |
| 2240326 | 7/1991 | United Kingdom | 206/821 |
| 8201536 | 5/1982 | WIPO | 206/151 |

*Primary Examiner*—Jimmy G. Foster

*Attorney, Agent, or Firm*—Andrus, Sceales, Starke & Sawall

[57] ABSTRACT

A pair of identical thermoformed bottle holders support the bases and top portions of an array of glass bottles in an enclosing carton in a manner which spaces and flexibly cushions all portions of the bottles from the direct transmission of an impact through any carton wall.

11 Claims, 3 Drawing Sheets

BOTTLE HOLDER AND BOTTLE HOLDING SYSTEM

BACKGROUND OF THE INVENTION

The present invention pertains to a holder for use in packaging glass bottles and, more particularly, to a packaging system using identical thermoformed flexible plastic holders to support the bottles within an enclosing carton to space and cushion the bottles from all carton walls.

The prior art is replete with holders and spacers for multi-bottle packages which are intended to hold an array of bottles in a uniformly spaced arrangement inside an enclosing container, such as a corrugated paperboard carton or the like. The prior use of paperboard separators and fillers has largely been replaced with the use of molded plastic separating and holding devices. U.S. Pat. Nos. 1,982,785 and 3,294,270 are representative of packaging systems utilizing paperboard or paper-like bottle holders and separators for use inside an enclosing carton. U.S. Pat. No. 4,911,300 shows a more recent use of bottle holders and separators constructed of plastic. In particular, this patent shows the use of separate thermoformed trays, each of which is specifically constructed to accommodate either the lower base portions of the bottles or the tops of the bottle necks, but not both. A problem common to all of the foregoing bottle packaging systems is that one or both of the upper and lower ends of the bottles lie in direct contact with an upper or lower carton wall or are separated therefrom only by a layer of material from which the bottle holder is formed. Thus, there is no real cushioning of the bottles so as to protect the glass from breakage as a result of a direct impact on the carton wall against which an end of the bottle is in contact. U.S. Pat. No. 4,093,068 shows a packaging system for cylindrical cans which uses sheets of plastic bubble material to separate and cushion the can ends from the upper and lower walls of the enclosing carton.

SUMMARY OF THE INVENTION

The present invention is directed to a thermoformed plastic bottle holder and a packaging system utilizing an identical pair of such holders to support an array of frangible bottles in an enclosing carton in a manner to cushion and space the bottles from the top and bottom carton walls, as well as the carton side walls.

In accordance with the packaging system of the present invention, a pair of identical thin flexible bottle holders each includes a main frame portion which has a planar upper surface and an interior array of receptacles for the bottles. Each bottle receptacle has an intermediate floor portion which is adapted to receive and support the base of a bottle and an integral downwardly depending cushion which includes a lower floor portion. An opening in the lower floor portion is defined by an annular lip and the opening is adapted to receive the neck of a bottle inserted therethrough so that the annular lip rests on the tapered transition between the neck and the base of the bottle with the top of the bottle neck positioned below the planar upper surface of the main frame portion. An enclosing carton includes planar top and bottom walls and enclosing side walls such that the carton will receive the bottle holders and the array of bottles with the lower floor portions of one of the holders resting on the carton bottom wall, the bases of the bottles resting on the intermediate floor portions of that one holder, the annular lips of the other holder resting on the transition surfaces of the bottles, the carton top wall resting on the upper surface of the main frame portion, and the outer edges of the frame portions engaging the carton side walls. When the carton is closed, the bottles are held spaced from all of the carton walls and cushioned by the flexible plastic holders from direct impact.

The holders are preferably thermoformed from a plastic sheet material, such as PET. In the preferred embodiment, the main frame portion of each holder includes an outer wall which depends downwardly from the planar upper surface and terminates in a lower peripheral edge, such that the lower floor portions of the bottle receptacles are disposed in a plane below the lower peripheral edge.

In the preferred construction of the bottle holder, the unitary flexible plastic frame includes a peripheral outer edge and integral cross members extending between opposite frame edges, and a series of receptacles formed between the outer edge and cross members. Each of the receptacles has an intermediate floor portion which is adapted to receive and support the base of the bottle. The intermediate floor portion includes an open center part which is defined by a downwardly depending collar that terminates in an annular lip. The annular lip defines a lower floor portion with an opening therein smaller than and concentric with the open center part, which opening is adapted to receive therethrough the neck of a bottle. The lower floor portions of the bottle receptacles lie in a common plane parallel to and spaced below a plane defining the bottom of the outer edge of the frame. The openings in the lower floor portions are sized to allow the bottle necks to pass therethrough and the annular lip to rest on the transition surface of the bottle between the neck and the base. The holder frame includes a planar upper surface which is spaced above and parallel to a plane through the tops of the bottle necks when the array of bottles is positioned with the annular lips resting on the respective bottle transition surfaces. This bottle holder construction allows an identical pair of bottle holders to be used as the bottom and top cushioning supports when the array of bottles is enclosed in a carton.

DETAILED DESCRIPTION OF THE PREFERRED EMBODIMENT

Figure 1:
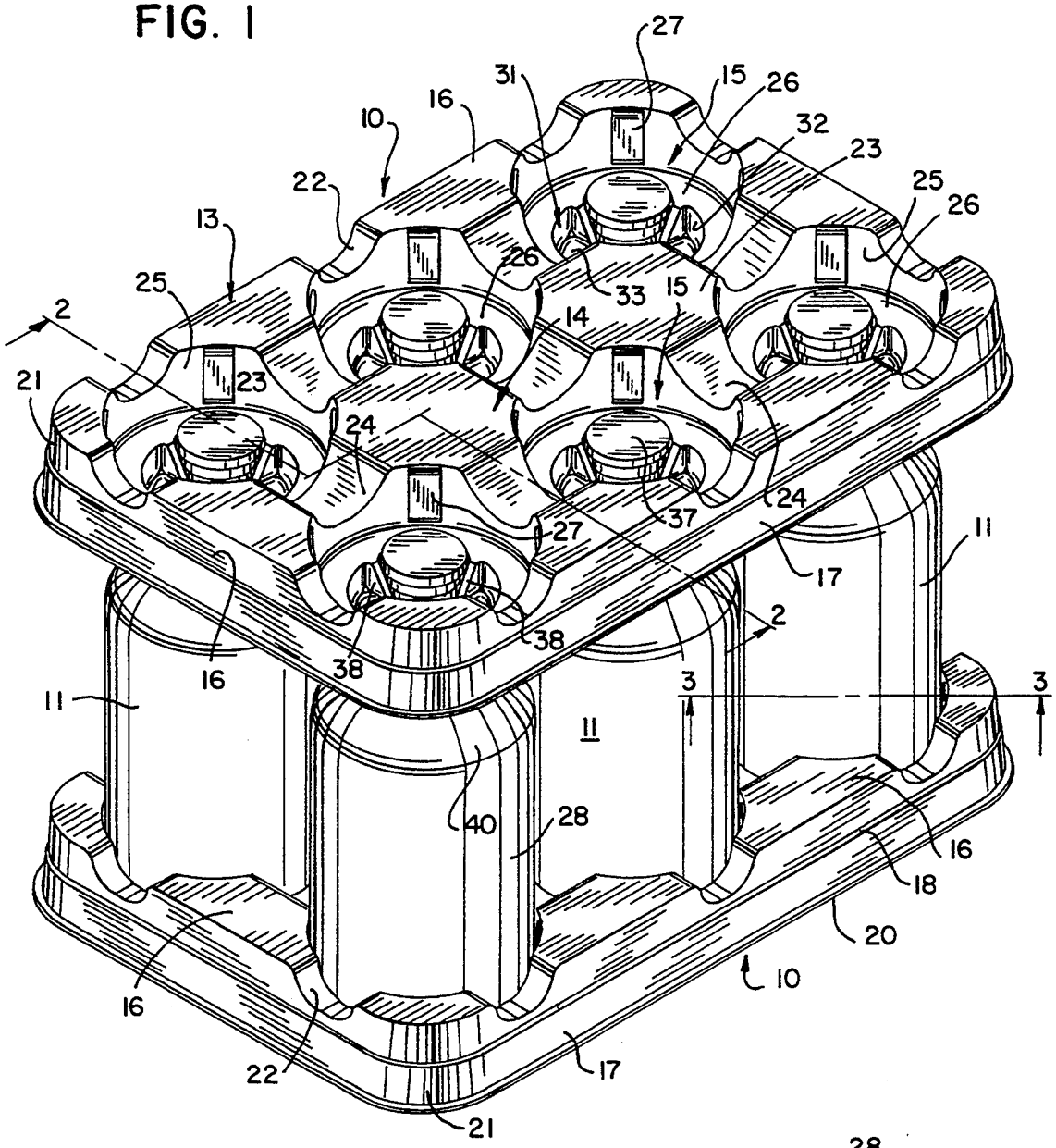
FIG. 1 is a perspective view of a pair of identical bottle holders of the present invention shown supporting an array of bottles.
Figure 2:
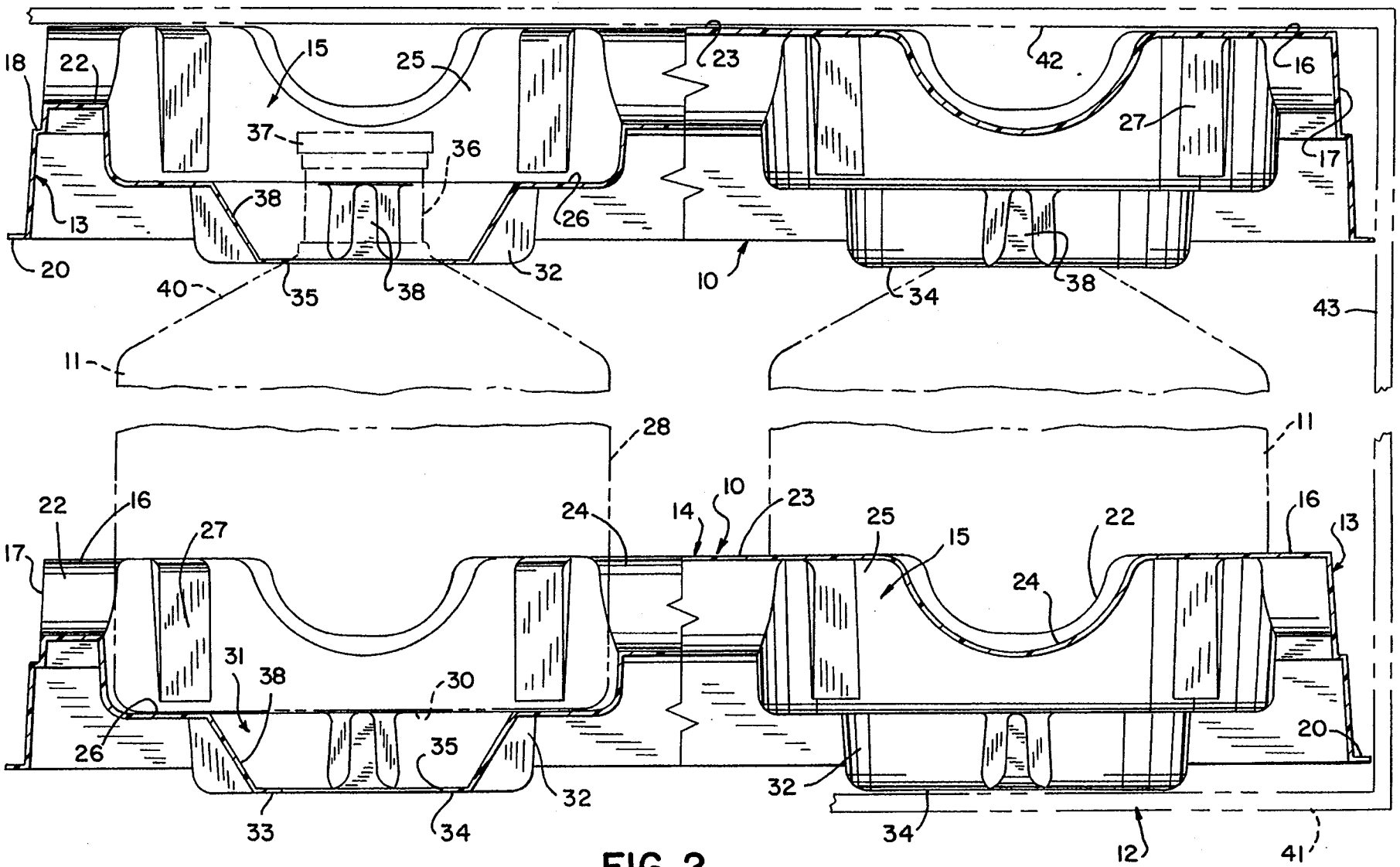
FIG. 2 is an enlarged sectional view taken on line 2—2 of FIG. 1 and additionally showing a portion of the enclosing carton.

Referring to FIGS. 1 and 2, a pair of identical bottle holders 10 are preferably thermoformed from a sheet of suitable plastic material, such as 0.040 inch (1.0 mm) PET. The holders 10 are positioned to support an array of glass bottles 11 for enclosure in a container, such as a paperboard carton 12.

The thinness of the plastic sheet material from which the holders are formed, imparts an inherent flexibility to the holder which includes a main outer frame 13 connected by integral cross members 14 extending between opposite edges of the frame. The frame and cross members define a series of receptacles 15 for the bottles 11, the details of which will be described hereinafter. It is to be understood that bottle holders utilizing the principal features of the present invention could be formed for an array of as few as two bottles, as well as for arrays of a substantially larger number of bottles than the 6-bottle array shown in the drawings. Obviously, a holder for a 2-bottle array would include only a single cross member 14 separating the two receptacles 15.

Figure 3:
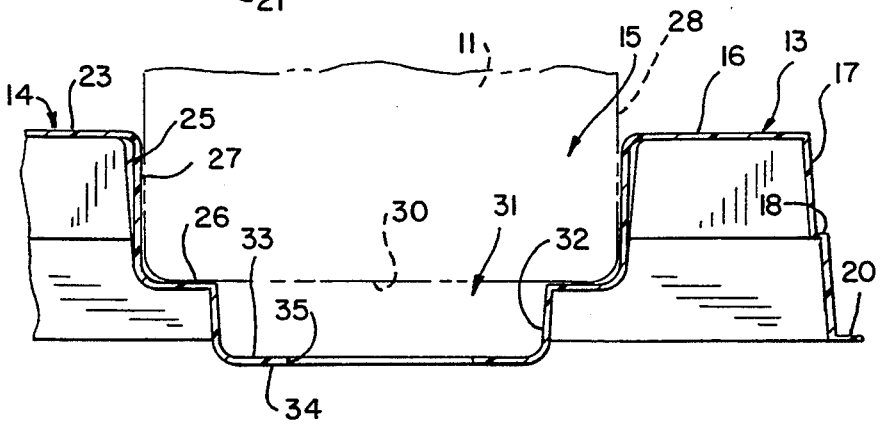
FIG. 3 is an enlarged partial sectional view taken on line 3—3 of FIG. 1.

Referring also FIG. 3, the outer frame 13 includes a generally planar upper surface 16 and a downwardly depending outer wall 17. The outer wall 17 may include an intermediate stepped edge 18 and a lower peripheral lip 20 to enhance its strength and accommodate nesting, all without detracting from the inherent flexibility provided by the frame. The planar upper surface 16 of the outer frame is generally rectangular in plan view, but is rounded at the corners 21, as are the corresponding portions of the outer wall 17. The planar upper surface 16 is interrupted by spaced semicylindrical depressions 22 to provide some additional rigidity to the holder.

The cross members 14 also include substantially planar upper surfaces 23 which lie coplanar with the upper surface 16 of the outer frame and, in the embodiment shown, are spaced therefrom and from each other by semicylindrical depressions 24 which are somewhat wider and deeper than the depressions 22 in the surface 16 of the outer frame 13.

Each bottle receptacle is defined by a side wall 25, formed by portions of the outer frame 13 and cross members 14 and an intermediate floor portion 26 extending horizontally from the bottom of the side wall 25. The side wall 25 is formed with a slight angular draft and is interrupted by four spaced abutment surfaces 27 which are generally vertically disposed. The abutment surfaces 27 engage the outer wall of the base 28 of the bottle 11 while the bottom surface 30 of the bottle rests on the intermediate floor portion 26.

The intermediate floor portion 26 of each receptacle 15 includes an open center part 31 which is defined by a downwardly depending collar 32 which collar terminates in a horizontal annular lip 33. The annular lip 33 defines a lower floor portion 34, and the inner peripheral edge of the lip 33 defines a circular opening 35 which is smaller than and concentric with the open center part 31 of the bottle supporting intermediate floor portion 26. The circular opening is normally provided in a separate die cutting operation after the holder has been thermoformed. The circular opening 35 is large enough to receive the neck 36 of the bottle 11, including the cap 37. The downwardly depending collar 32 and lower floor portion 34 are provided with four integral circumferentially spaced gussets 38 to provide additional stiffening for the lip and lower floor portion while still retaining an inherent flexibility. Preferably, the lower floor portions 34 of the holder lie in a horizontal plane which is spaced below the plane of the lower edge of the outer frame 13, as defined by the lower peripheral lip 20. However, the lower edge of the outer frame member 13, including the lip 20, could lie coplanar with the lower floor portions 34 or even extend below the plane of the floor portions. This embodiment will be described in greater detail hereinafter.

After an array of bottles 11 is inserted in the receptacles 15 of a lower holder 10, an identical upper holder is placed over the bottles so that the necks 36 pass completely therethrough until the edges of the annular lips 33 defining the openings 35 in the lower floor portions come to rest on the tapered transition surfaces 40 between the base 28 and neck 36 of each bottle. The holders are also appropriately dimensioned so that when the upper holder 10 is supported on the top surfaces of the bottles, as best shown in FIG. 2, the tops of the bottles defined by the caps 37 are spaced a substantial distance below the planar upper surface 16 of the frame and the common planar surfaces 23 of the cross members. Similarly, the bottom surfaces 30 of the bottles, resting on the intermediate floor portions 26, are spaced by a substantial distance above the lower floor portions 34. When the assembly of bottles and two holders is enclosed in a container, such as a generally rectangular paperboard carton 12, the lower floor portions 34 of the bottom holder will rest on the bottom wall 41 of the carton, the bases of the bottles will rest on the cushioned support provided by the intermediate floor portions 26, the annular lips 33 of the upper holder will rest on the bottle transition surfaces 40 and the carton top wall 42 is closed to rest on the upper surfaces 16 and 23 of the main frame. Finally, the outer edges of the frames 33, as defined by the lower peripheral lips 20, engage the carton side walls 43 to hold the entire assembly firmly in position with the bases 28 of the bottles spaced substantially from the side walls 43.

A sharp impact blow to any wall of the carton 2 will be absorbed and cushioned against direct transmission to a bottle by the unique flexible spacing provided as described herein. Specifically, the downwardly depending collars 32 and integral lower floor portions 34 cushion the bases of the bottle, the annular lips 33 in the upper holder 10 provide a flexible cushioning at the upper ends of the bottles, and the frame outer walls 17 surrounding and spaced from the receptacle side walls 25 cushion against lateral impacts through the side walls 43. Proper sizing of the carton 12 provides firm lateral support by carton side walls 43, and firm vertical support by capturing the lower floor portions 34 of the lower holder and the upper surface 16 of the upper holder between the bottom and top carton walls 41 and 42, respectively. The packaging system of the present invention thus precludes direct transmission of an impact blow or other force on a carton wall to any surface of a bottle.

Figure 4:
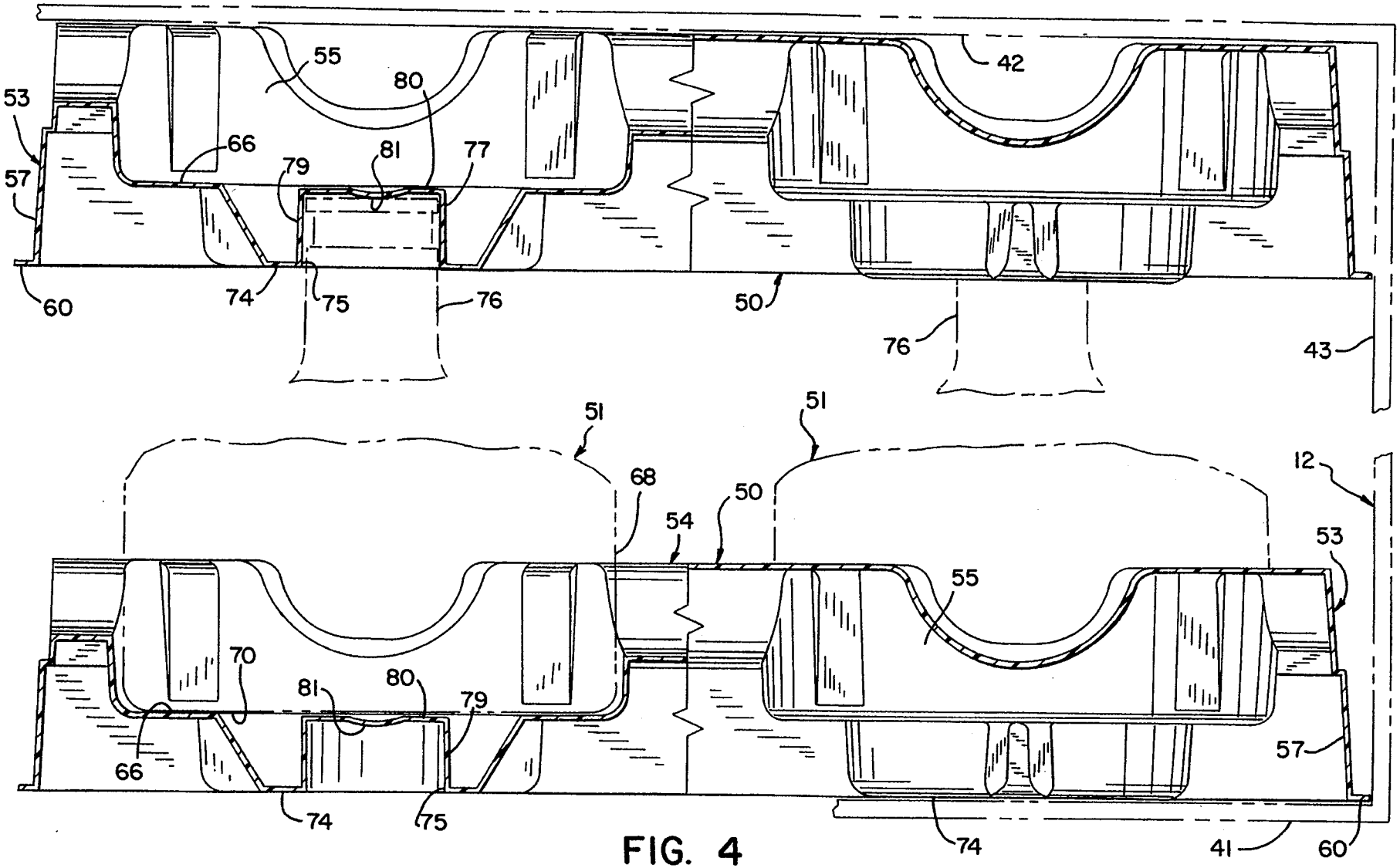
FIG. 4 is a view similar to FIG. 2 showing an alternate embodiment of the bottle holding system of the present invention.

In FIG. 4, there is shown an alternate embodiment of the bottle holder as utilized in a packaging system similar to that described above and shown in FIG. 2. Each of the bottle holders 50 of this embodiment is modified in two respects from the holders 10 of the previously described preferred embodiment. Each of the holders 50 has an outer wall 57 forming part of the outer frame 53 which is elongated in a vertical direction so that the lower peripheral lip 60 lies generally coplanar with the lower floor portions 74 defining the lowermost surface of the holder receptacles 55. Thus, when placed in a carton 12, the lower holder 50 will be supported on the carton bottom wall 41 by the peripheral lower lip 60 and the lower floor portions 74.

The other difference in the FIG. 4 embodiment is that each of the openings 75 in the lower floor portions 74 is defined by an upwardly extending cylindrical sleeve 79 which terminates in a top wall 80. The sleeve 79 is adapted to receive the neck 76 of a modified bottle 51 with the bottle cap 77 engaging the top wall 80 of the sleeve. The top wall 80 may be provided with a centered dimple 81 to enhance somewhat the cushioning effect provided. The lower floor portions 74 in this embodiment do not rest upon the transition surface between the neck 77 and the base 68 of the bottle as in the previously described embodiment.

In all other respects, however, the modified bottle holders of the FIG. 4 embodiment operate in essentially the same manner as the holders 10 of the preferred embodiment. However, when the bottles 51 are inserted into the receptacles 55 of the lower holder 50, the bottom surfaces 70 of the bottles rest upon the upper surfaces of the top walls 80 of the sleeves 79 as well as on the intermediate floor portions 66 of the receptacles 55. The sleeves 79 may, however, be made somewhat shorter in a vertical direction such that the top walls 80 lie below the plane of the intermediate floor portions 66, in which case, the bases 68 of the bottles would rest only on the intermediate floor portions 66.

Although the bottle holder of the present invention has been described for use with an array of two or more glass bottles, it could be adapted as well to carry a single bottle in an enclosing carton. Such a holder would be of essentially the same construction as described with respect to the two foregoing embodiments, except the single bottle holder would not require cross members 14 or 54 and would, of course, include only a single bottle receptacle 15 or 55.

Various modes of carrying out the present invention are contemplated as being within the scope of the following claims particularly pointing out and distinctly claiming the subject matter which is regarded as the invention.

We claim:

1. A holder for an array of frangible bottles comprising a unitary flexible plastic frame having a peripheral outer edge and integral cross members extending between opposite edges, a series of receptacles between said outer edge and cross members and formed integrally therewith, each of said receptacles defining a well having a flat annular intermediate floor portion adapted to receive and support the base of a bottle, an open center part in the intermediate floor portion defined by a downwardly depending collar terminating in a flat annular lip disposed parallel to said intermediate floor portion, said lip defining a lower floor portion and having a free inner edge defining an opening in said lower floor portion smaller than and concentric with said open center part and adapted to receive the neck of the bottle.

2. The bottle holder as set forth in claim 1 wherein the lower floor portions lie in a plane parallel to and spaced below a plane defining the bottom of the outer edge of said frame.

3. The bottle holder as set forth in claim 1 wherein said opening is sized to allow the annular lip to rest on the transition surface of the bottle between the neck and the base.

4. The bottle holder as set forth in claim 3 wherein the frame includes a planar upper surface spaced above and parallel to a plane through the tops of the bottle necks when the array of bottles is positioned with the annular lips of the holder resting on the respective bottle transition surfaces.

5. The bottle holder as set forth in claim 1 wherein the opening in the lower floor portion is defined by an upwardly extending cylindrical sleeve and said sleeve terminates in a generally horizontal enclosing top wall.

6. The bottle holder as set forth in claim 1 wherein the lower floor portions lie generally in a plane defining the bottom of the outer edge of said frame.

7. A packaging system for an array of frangible bottles, each bottle having a base, a neck and a tapered transition surface between the base and neck, said system comprising:

a pair of thin, flexible plastic bottle holders, each holder including a main frame portion having a planar upper surface and an interior array of receptacles for the bottles;

each of the receptacles having an intermediate floor portion adapted to receive and support the base of a bottle and an integral downwardly depending cushion including a lower floor portion;

one of said holders having an opening in each of said lower floor portions, said opening adapted to receive the bottle neck therethrough with the part of the lower floor portion defining said opening resting on an upper part of the bottle above the base and the top of the bottle neck positioned below the planar upper surface of said main frame portion; and, an enclosing carton having a planar bottom wall, a planar top wall, and enclosing side walls, said carton adapted to receive the bottle holders and bottles with the lower floor portions of the other of said holders resting on the carton bottom wall, the bases of the bottles resting on the intermediate floor portions of said other holder, the lower floor portions of said one holder resting on the upper parts of the bottles, the carton top wall resting on the upper surface of the main frame portion of said one holder, and the outer edges of the frame portions of both holders engaging the carton side walls;

whereby the bottles are held spaced from the carton walls and cushioned from direct impact.

8. The packaging system as set forth in claim 7 wherein said holders are thermoformed from plastic sheet material.

9. The packaging system as set forth in claim 7 wherein the main frame portion of the holder includes an outer wall depending downwardly from the planar upper surface and terminating in a lower peripheral edge, and wherein said lower floor portions are disposed in a plane below said lower peripheral edge.

10. A holder for a frangible bottle comprising a unitary flexible plastic frame having a peripheral outer edge, a receptacle enclosed within said outer edge and formed integrally therewith, said receptacle defining a well having a flat annular intermediate floor portion adapted to receive and support the base of a bottle, an open center part in the intermediate floor portion defined by a downwardly depending collar terminating in a flat annular lip disposed parallel to said intermediate floor portion, said lip defining a lower floor portion and having a free inner edge defining an opening in said lower floor portion smaller than and concentric with said open center part and adapted to receive the neck of the bottle.

11. A packaging system for a frangible bottle having a base, a neck and a tapered transition surface between the base and neck, said system comprising:

a pair of identical thin, flexible plastic bottle holders, each holder including a main frame portion having a planar upper surface and an interior receptacle for the bottle;

said receptacle having an intermediate floor portion adapted to receive and support the base of a bottle and an integral downwardly depending cushion including a lower floor portion;

an opening in said lower floor portion defined by an annular lip, said opening adapted to receive and hold the bottle neck therein with the top of the bottle neck positioned below the planar upper surface of said main frame portion; and, an enclosing carton having a planar bottom wall, a planar top wall, and enclosing side walls, said carton adapted to receive the bottle holders and bottle with the lower floor portions of one of said holders resting on the carton bottom wall, the base of the bottle resting on the intermediate floor portion of said one holder, the annular lip of the other holder resting on the transition surface of the bottle, the carton top wall resting on the upper surface of said main frame portion, and the outer edges of the frame portions engaging the carton side walls;

whereby the bottle is held spaced from the carton walls and cushioned from direct impact.

* * * * *